US006926623B2

(12) United States Patent
Lin

(10) Patent No.: US 6,926,623 B2
(45) **Date of Patent: *Aug. 9, 2005**

(54) BASEBALL SERVER APPARATUS WITH A DELAY TIMER ELEMENT FOR PROVIDING A DELAYING TIME PERIOD FOR SERVING-UP A BASEBALL

(75) Inventor: Chiu Yuan Lin, Feng Yuan Taichung (TW)

(73) Assignee: Yuanen Leih Co., Ltd. (TW)

( * ) Notice: Subject to any disclaimer, the term of this patent is extended or adjusted under 35 U.S.C. 154(b) by 0 days.

This patent is subject to a terminal disclaimer.

(21) Appl. No.: 10/746,299

(22) Filed: Dec. 24, 2003

(65) Prior Publication Data

US 2004/0138011 A1 Jul. 15, 2004

Related U.S. Application Data

(63) Continuation-in-part of application No. 10/309,372, filed on Dec. 5, 2002, now Pat. No. 6,719,649.

(51) Int. Cl.[7] ..... A63B 71/00
(52) U.S. Cl. ..... 473/417; 473/422
(58) Field of Search ..... 473/417, 422, 473/471, 453, 133, 138; 273/317.6, 317.2, 332, 390, 391, 407; 124/61, 17

(56) References Cited

U.S. PATENT DOCUMENTS

| | | | | | |
|---|---|---|---|---|---|
| 221,694 | A | * | 11/1879 | Mulholland | 124/16 |
| 2,664,077 | A | * | 12/1953 | Moore | 124/16 |
| 2,705,003 | A | * | 3/1955 | Schensted | 124/16 |
| 3,856,300 | A | * | 12/1974 | Payne | 124/16 |
| 4,227,691 | A | * | 10/1980 | Lefebvre et al. | 473/417 |
| 4,938,478 | A | * | 7/1990 | Lay | 473/423 |
| 5,672,124 | A | * | 9/1997 | Pecoraro et al. | 473/417 |
| 5,800,288 | A | * | 9/1998 | Mims | 473/417 |
| 6,719,649 | B1 | * | 4/2004 | Lin | 473/417 |

* cited by examiner

*Primary Examiner*—Gregory Vidovich
*Assistant Examiner*—M. Chambers
(74) *Attorney, Agent, or Firm*—Ezra Sutton, Esq.

(57) ABSTRACT

A ball server apparatus for conducting batting practice wherein the apparatus ejects a ball into the air and the user swings a bat in order to hit the ejected ball. The ball server apparatus includes a base member connected to a server seat member, the base member for stabilizing the server seat member on a playing surface. The server seat member includes an interior section having a vertical channel extending therethrough; the interior section of the server seat member includes an upper seat section, a middle seat section and a bottom seat section. The ball server apparatus further includes a movable rod having a proximal end and a distal end; the proximal end of the movable rod is within the bottom seat section of the server seat member; the proximal end of the movable rod has an ejection assembly connected thereto; the distal end of the movable rod has a ball seat member connected thereto; and the ball seat member is used for holding a portion of the ball therein. The ball server apparatus includes a foot touch plate assembly for actuating the ejection assembly in order to upwardly move the movable rod within the vertical channel for ejecting the ball from the ball seat member. Additionally, the ball server apparatus includes a delay timer element positioned within the interior section of the server seat member for delaying the ejection of the ball from the seat member in order to allow time for the user to prepare for a swinging movement prior to the ejection of the ball.

28 Claims, 7 Drawing Sheets

BASEBALL SERVER APPARATUS WITH A DELAY TIMER ELEMENT FOR PROVIDING A DELAYING TIME PERIOD FOR SERVING-UP A BASEBALL

RELATED APPLICATIONS

This is a continuation-in-part of application Ser. No. 10/309,372, filed on Dec. 5, 2002 now U.S. Pat. No. 6,719,649.

FIELD OF INVENTION

The present invention relates to a baseball server apparatus, and more particularly to a baseball server apparatus having a delay timer element for delaying a movable rod so that a batter has a delayed time period for preparing the batter for the next swinging movement in order to hit the baseball from the baseball server apparatus.

BACKGROUND OF THE INVENTION

Baseball is a popular sport and exercise in many countries such as the United States, Mexico, Canada, Cuba, Dominican Republic, Haiti, Venezuela, and Japan. Usually a baseball game must be played by nine baseball players per team. If only one person desires to play baseball, a problem arises of not having at least a pitcher, a catcher and a batter (hitter) for batting practice by a player. To overcome this defect, in the prior art, a baseball server for a single user was developed to eliminate the need for a pitcher and a catcher. In one prior art patent, the baseball server throws a baseball which has a flying path simulating the traveling path of the baseball from a pitcher. However, this prior art baseball server needs a larger area for use, so that it is inconvenient for many users.

Another problem occurs when a user plays batting practice in a self-batting format with no mechanical equipment involved, wherein the batter throws a baseball upwards and then hits the baseball with a bat. The flight path of the baseball will be affected by the behavior of the batter such that the flight path of the baseball is either unfair or beneficial to the batter and does not represent a proper swinging movement by the batter. Moreover, after the baseball is thrown upward, the user must then hold and swing the bat quickly, often missing the thrown upward and arching baseball. This time period is too short for the batter to react quickly for a proper swinging movement.

There remains a need for a baseball server apparatus having a delaying timer element for delaying the upward movement of a baseball between batting swings of a single baseball player. The baseball server apparatus should also include a foot touch plate for actuating a movable rod within a server seat member in order to move the baseball in an upwardly arched flight path from the server seat member.

The prior art does not disclose or teach a baseball server apparatus using a novel ejection assembly and actuation means for propelling a baseball in an arched upwardly direction.

Accordingly, it is an object of the present to provide a baseball server apparatus having a delay timer element for delaying a movable rod so that a batter has a delayed time period for preparing the batter for his or her next swinging movement in order to hit the ejected baseball from the baseball server apparatus.

Another object of the present invention is to provide an ejection assembly for propelling the baseball in an upwardly direction such that the batter can adequately swing his or her bat in order to hit the baseball from the baseball server apparatus.

Another object of the present invention is to provide a foot touch plate assembly for actuating a movable rod within a server seat member in order to move the baseball in an upwardly arched flight path from a detachable baseball seat member.

Another object of the present invention is to provide a baseball server apparatus that is simple to use, uses only a limited space, is easy to maintain, and is capable of withstanding everyday wear and tear.

A still further object of the present invention is to provide a baseball server apparatus that can be mass produced in an automated and economical manner and is readily affordable by the consumer.

SUMMARY OF THE INVENTION

In accordance with the present invention, there is provided a baseball server apparatus having a server seat member, a movable rod inserted into the server seat member, an elastomeric ejection member, a foot touch plate, and a delay timer element within the server seat member. In using the baseball server apparatus, the movable rod is actuated by the foot touch plate, such that the movable rod interacts with the delay timing element and the baseball is positioned on a baseball seat member in conjunction with the movable rod. When the baseball server apparatus is actuated, the movable rod is delayed by the delay timer element such that ejection of the baseball is delayed, and then is ejected in a vertical arching motion, so the batter is able to have time to prepare for a swinging movement for hitting the baseball while it is in an elevated position. The moveable rod is then re-positioned within the server seat member, such that the batter has time to prepare for the next swinging movement.

BRIEF DESCRIPTION OF THE DRAWINGS

Further objects, features and advantages of the present invention will become apparent upon the consideration of the following detailed description of the presently-preferred embodiment when taken in conjunction with the accompanying drawings, wherein.

DETAILED DESCRIPTION OF THE PREFERRED EMBODIMENTS

Figure 5:
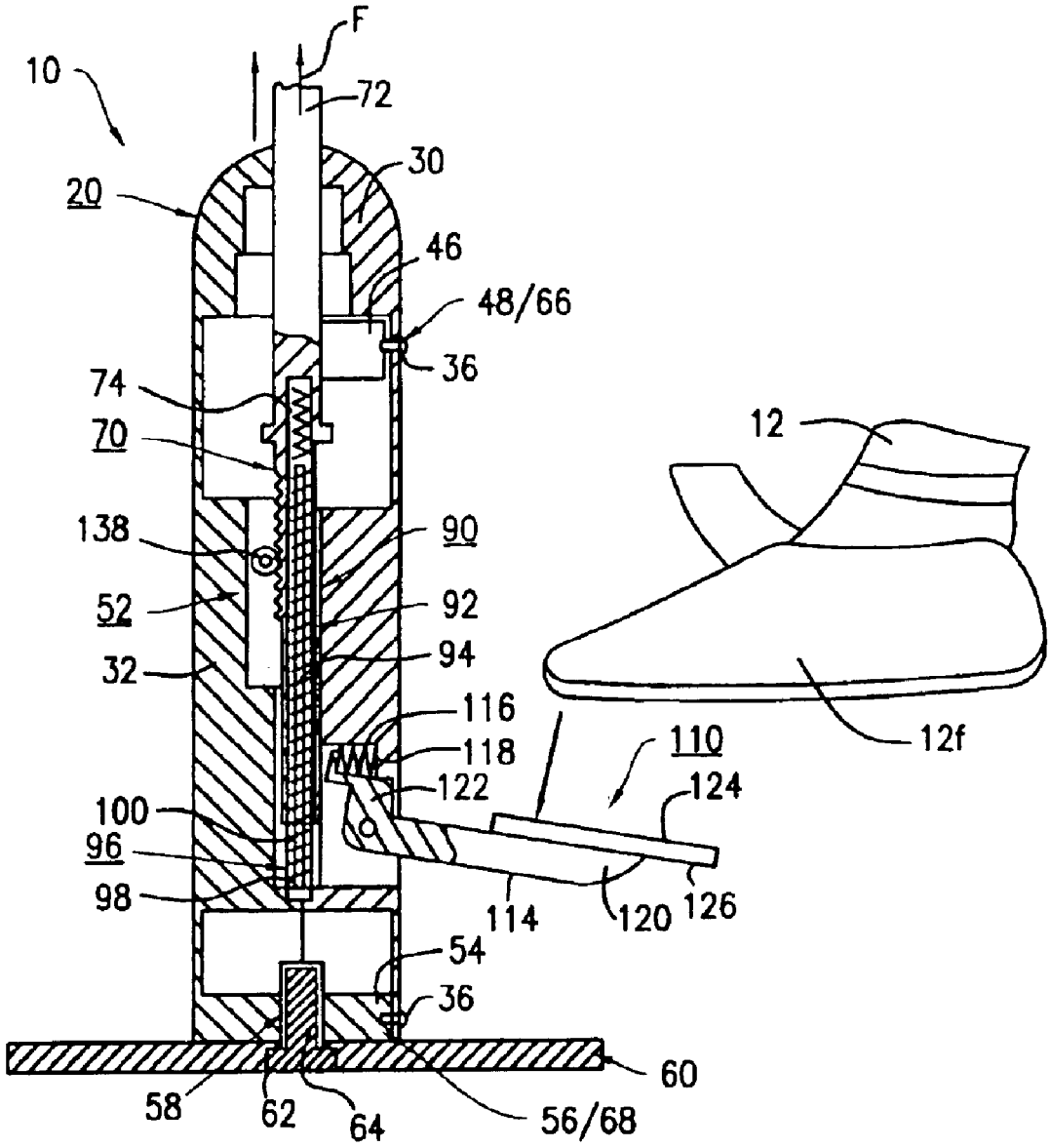
FIG. 5 is a cross-sectional view of the baseball server of the present invention taken along lines 5—5 of FIG. 1 in the direction of the arrows showing the driving movement of the movable rod as the foot touch plate is depressed downward and the delay timer element.
Figure 6:
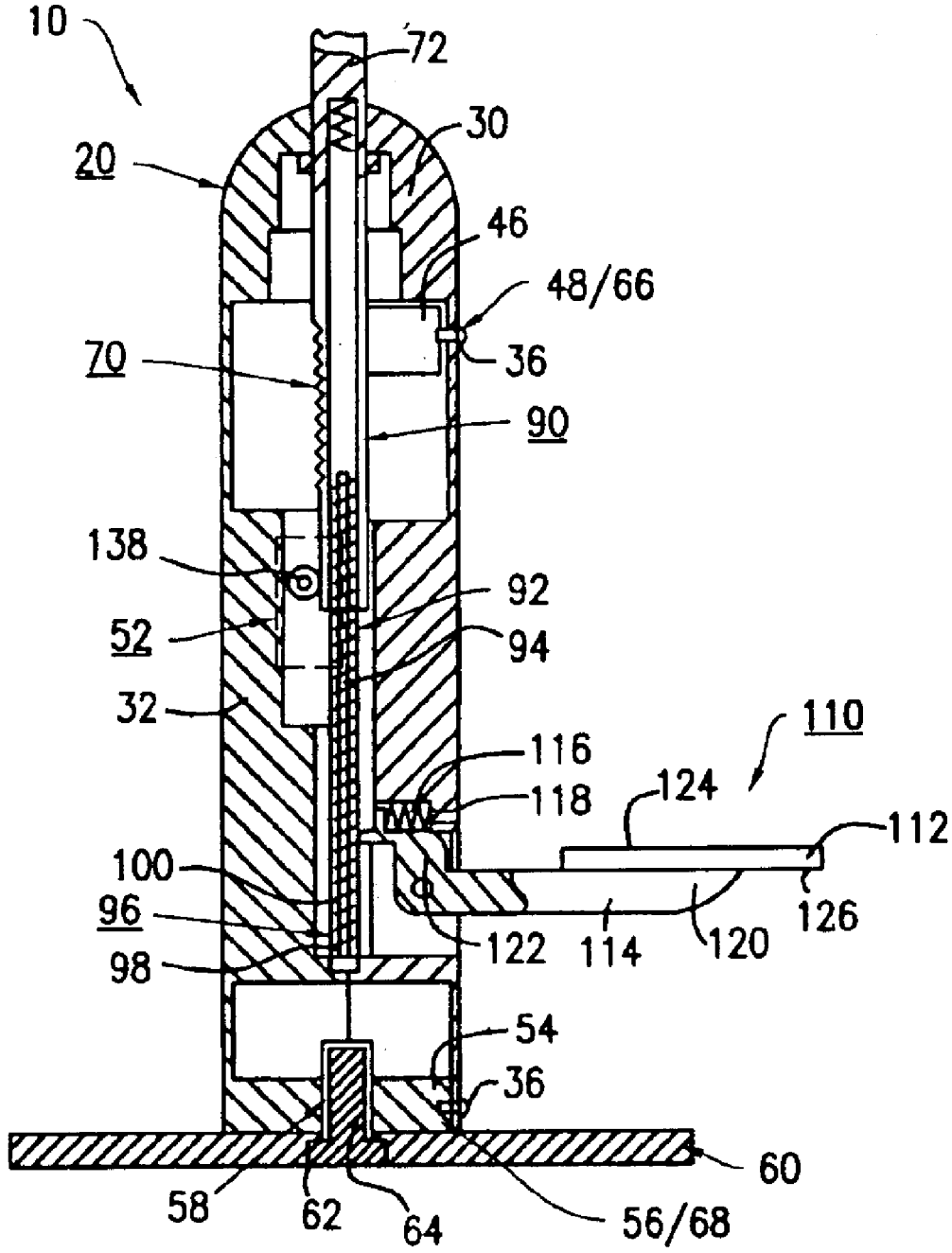
FIG. 6 is a cross-sectional view of the baseball server of the present invention taken along line 6—6 of FIG. 1 in the direction of the arrows showing the rising movement of the movable rod as the foot touch plate is released and the delay timer element.
Figure 7:
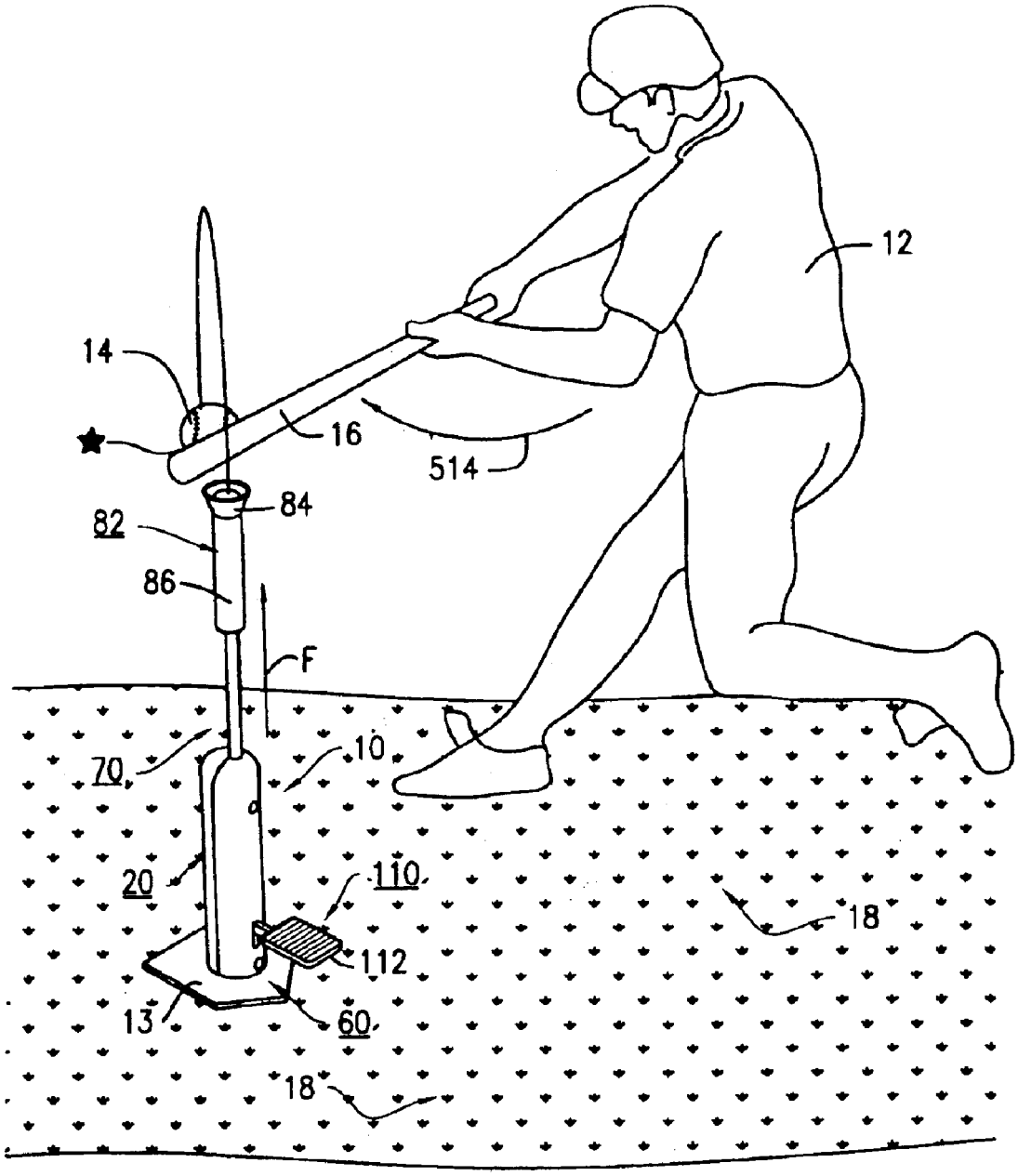
FIG. 7 is a perspective view of the baseball server of the present invention showing the baseball server in an assembled state and in operational use thereof by a single batter.

The baseball server apparatus 10 and its component parts of the preferred embodiment of the present invention are represented in detail by FIGS. 1 through 7 of the patent drawings. The baseball server apparatus 10 is used for batting practice by a single batter 12 swinging and hitting a baseball 14 by a bat 16, as depicted in FIG. 7 of the drawings. It should be understood that the term baseball is intended to include other types of balls.

Figure 1:
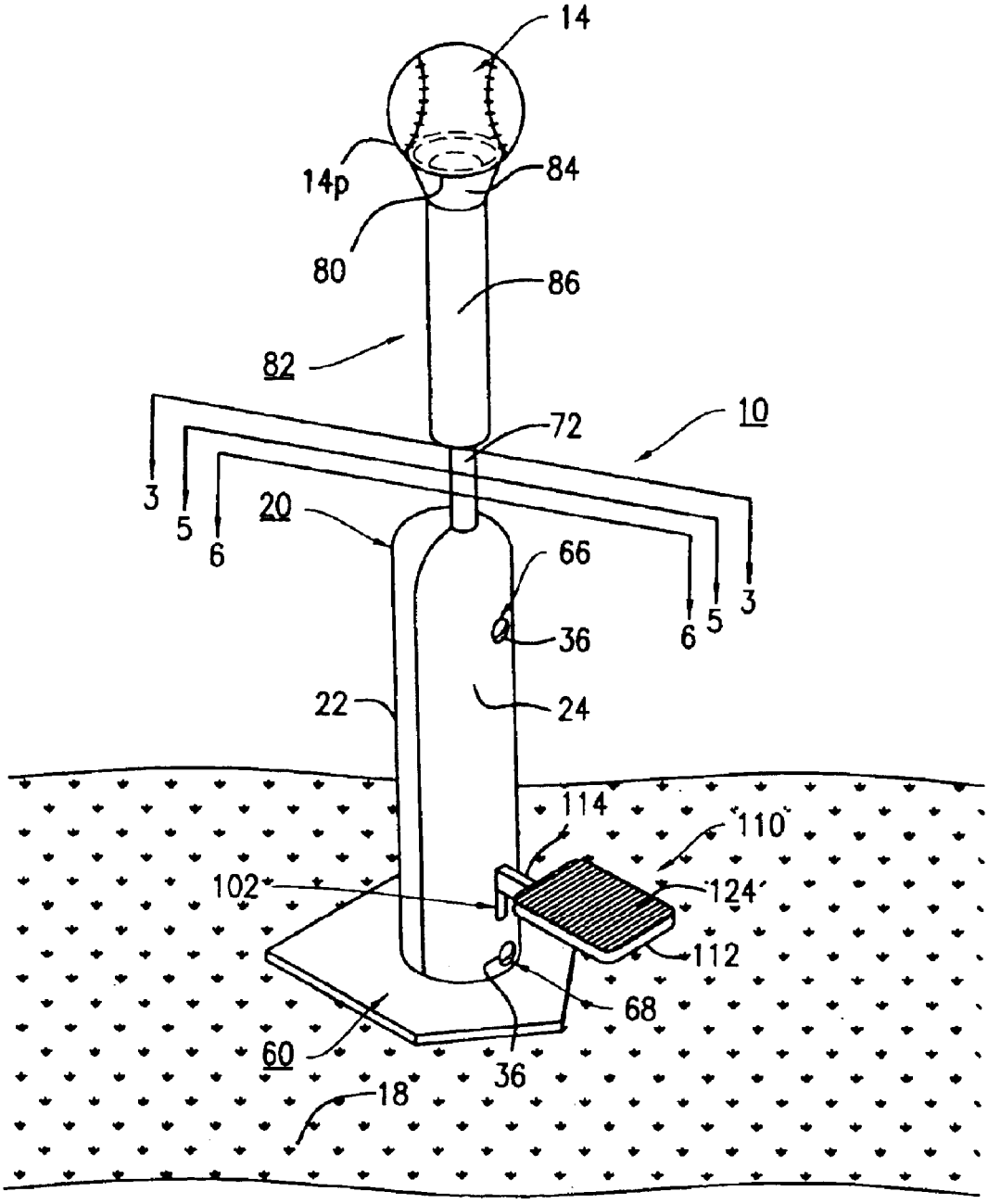
FIG. 1 is a perspective view of the baseball server of the preferred embodiment of the present invention showing the major component parts.
Figure 2:
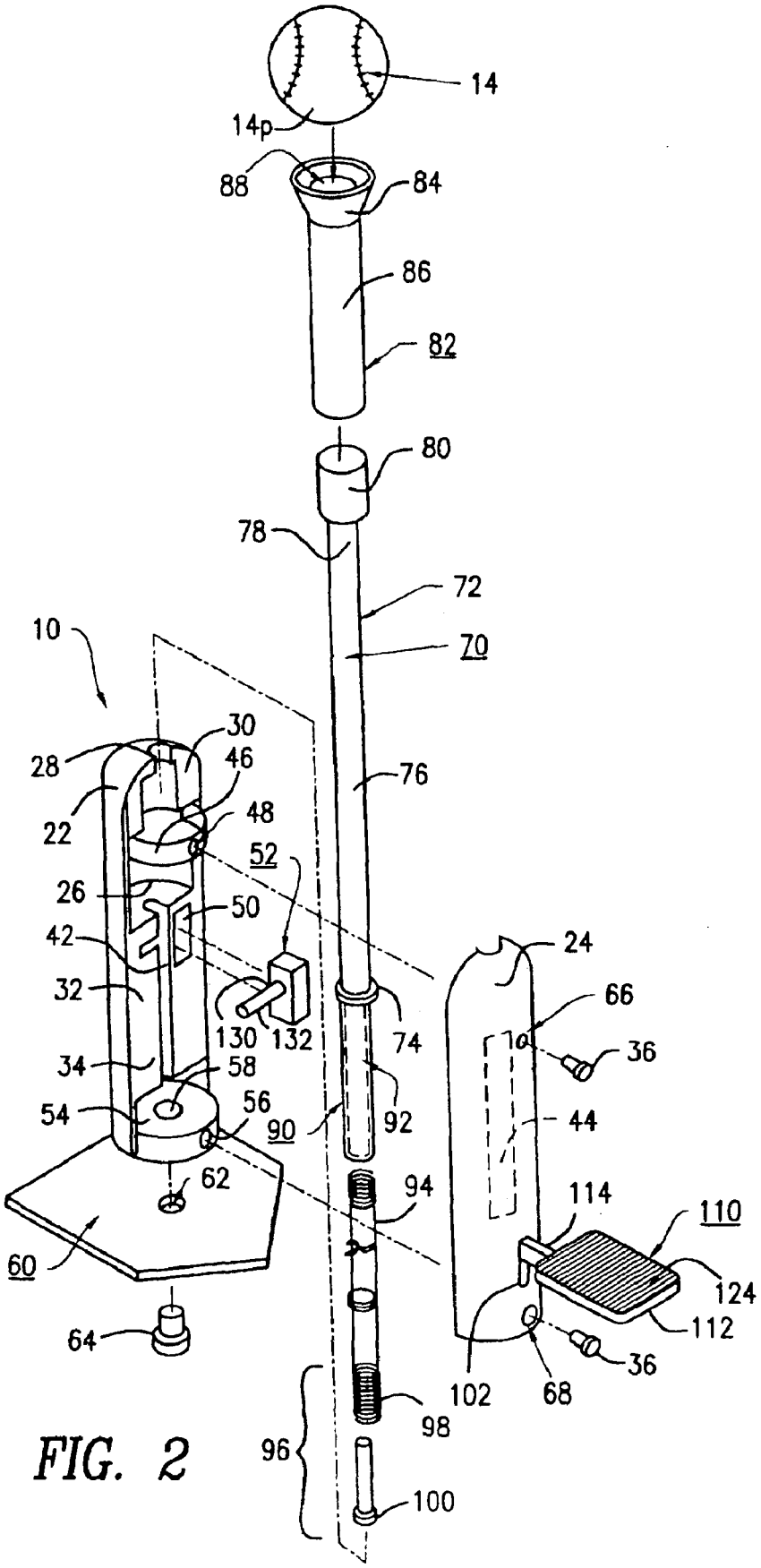
FIG. 2 is an exploded perspective view of the baseball server of the present invention showing a ball seat, a movable rod, a buckle ejection rod member, an elastomeric ejection member and a foot touch plate.
Figure 3:
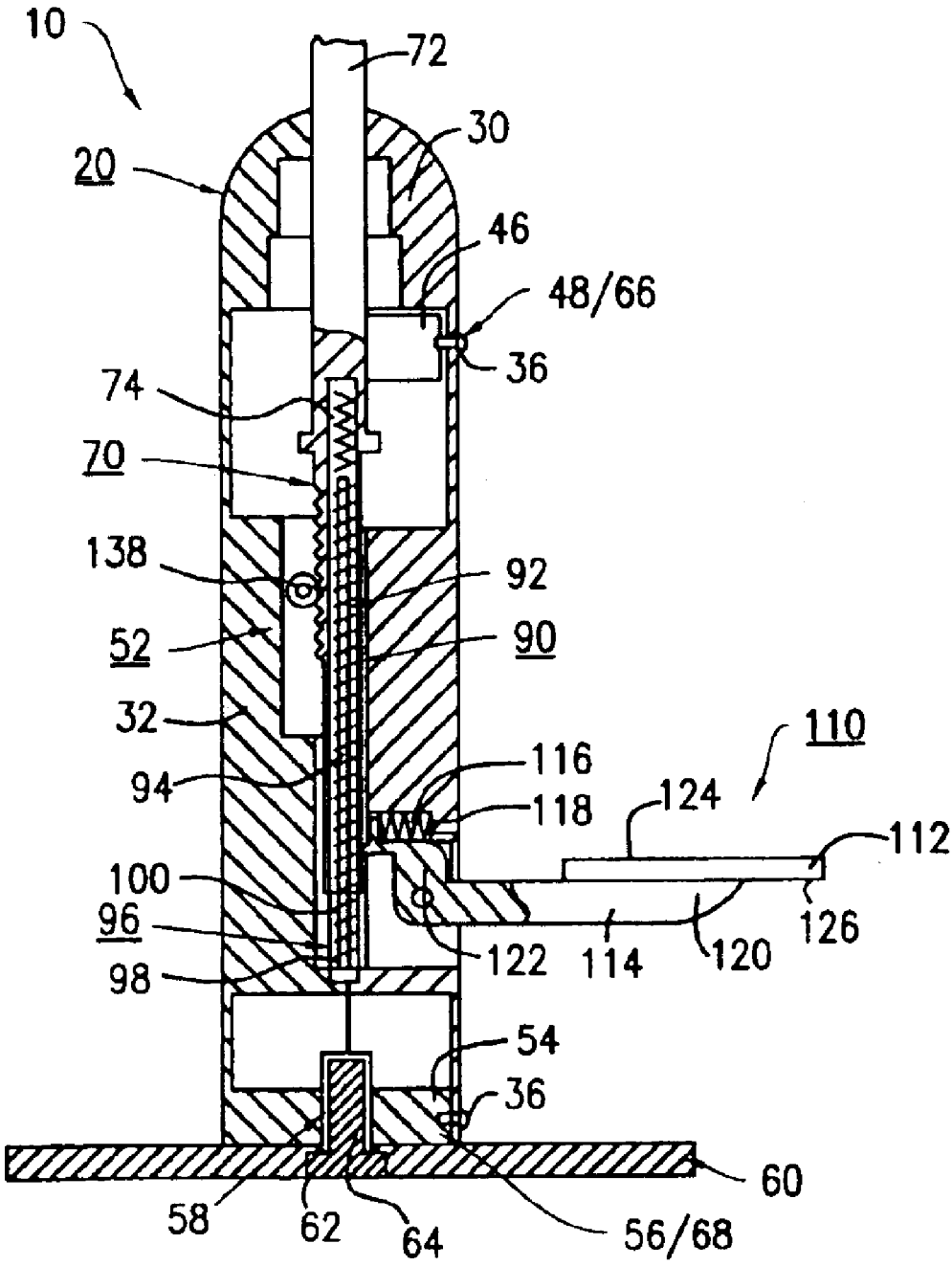
FIG. 3 is a cross-sectional view of the baseball server of the present invention taken along lines 3—3 of FIG. 1 in the direction of the arrows showing the movable rod, the buckle ejection rod member, the elastomeric ejection member and the foot touch plate.

As shown in FIGS. 1 through 3, the baseball server apparatus 10 of the present invention includes a server seat member 20 being housed in a first half shell casing 22 and a second half shell casing 24. The server seat member 20 includes an interior section 26 having a vertical through-hole opening or channel 28. The interior section 26 includes an upper seat section 30, a middle seat section 32 and a lower seat section 34. The vertical channel 28 is formed by first and second channel openings 42 and 44 within respective first and second half shell casings 22 and 24, respectively, as shown in FIG. 2 of the drawings.

The upper seat section 30 of interior section 26 includes a holding band 46 having an upper mounting opening 48 therein. The middle seat section 32 of interior section 26 includes a concave compartment 50 for receiving a delay timer element 52 therein, as shown in FIG. 2. The bottom seat section 34 of interior section 26 includes a holding seat member 54 having a lower mounting opening 56 and a centrally located mounting opening 58. The centrally located mounting opening 58 of the holding seat member 54 is used for connecting and attaching to a home plate member 60, as shown in FIGS. 1 and 2 of the drawings. The home plate member 60 is used as a base member to stabilize the baseball server apparatus 10 relative to the ground area 18 placement of the baseball server apparatus 10, as shown in FIGS. 1 and 7 of the drawings. The home plate member 60 includes a centrally located mounting opening 62 for receiving a mounting bolt 64 therethrough. The second half shell casing 24 includes an upper mounting opening 66 and a lower mounting opening 68. Each of the upper mounting openings 48 and 62 of holding band 46 and shell casing 24 are respectively aligned for receiving a mounting screw 36 therein. Also, each of the lower mounting openings 56 and 64 of holding seat member 54 and shell casing 24 are respectively aligned for receiving the mounting screw 36 therein. The attachment of mounting screws 36 to the aforementioned aligned mounting openings 48 and 62, and 54 and 64 are used for joining each of the first and second half shell casings 22 and 24 together to form the server seat member 20, as depicted in FIG. 1 of the drawings.

The baseball server apparatus 10, as shown in FIGS. 1 and 2, further includes an ejection assembly 70 having a movable rod 72 with a proximal end 74, a center section 76 and a distal end 78. The movable rod 72 passes through the server seat member 20, wherein the center section 76 and the proximal end 74 of the movable rod 72 passes through the vertical channel 28 of the server seat member 20. The distal end 78 of movable rod 72 extends and protrudes outwardly from the server seat member 20. The distal end 78 of movable rod 72 includes a baseball ram member 80 and a detachable baseball seat member 82 having an upper conical seat section 84 being integrally attached to a cylindrical collar section 86 with a through-hole opening 88 extending therethrough, as depicted in FIG. 2 of the drawings. The upper conical seat section 84 of the detachable ball seat member 82 is configured to hold a part 14*p* of the ball 14 therein, as shown in FIG. 1. It should be understood that the term "ball" is defined to include a baseball, a softball, a hardball, a tennis ball, a rubber ball, a whiffle ball, a racquet ball, a paddle ball, a handball, and the like.

The proximal end 74 of movable rod 72 includes a buckle ejection rod member 90 being positioned within the middle section 32 of the interior section 26 of server seat member 20 as shown in FIGS. 2 and 3 of the patent drawings. The buckle ejection rod member 90 includes a first buckle ejection rod 92 having a driven rod section 94. The driven rod section 94 is positioned within the first buckle ejection rod 92 of the buckle ejection rod member 90 as depicted in FIGS. 2, 3, 5 and 6 of the drawings. The ejection assembly 70 further includes an elastomeric ejection member 96 for being detachably received within the driven rod section 94, as shown in FIGS. 2, 3, 5 and 6 of the drawings. The elastomeric ejection member 96 includes a compressible spring 98 for cooperating with a piston rod 100 in order to allow an upward elastic force F on the movable rod 72, as shown in FIGS. 3 and 5 of the drawings. The elastomeric ejection member 96 is positioned within the middle section 32 of the server seat member 20 and is aligned within the vertical channel 28, as shown in FIGS. 3, 5 and 6 of the drawings.

As depicted in FIG. 3, the second half shell casing 24 further includes a slot opening 102 for receiving a lever arm 114 of a foot touch plate assembly 110 therein. The foot touch plate assembly 110 includes a foot touch plate pedal 112, a lever arm 114, and a touch plate rod 116 having a compressible spring 118 attached thereto. The lever arm 114 includes a proximal end 120 and a distal end 122. The touch plate pedal 112 includes an upper wall surface 124 and a bottom wall surface 126. The proximal end 120 of lever arm 114 is connected to the bottom wall surface 126 of touch plate pedal 112 and the distal end 120 of lever arm 114 is compressibly connected to the touch plate rod 116, as depicted in FIGS. 3, 5 and 6 of the drawings. The touch plate rod 116 is put into a standby mode S as the touch plate rod 116 is detachably buckled to the first buckle ejection rod 92 of the buckle ejection rod member 90. Thus, when the movable rod 72 is downwardly pressed into the bottom seat section 34 of the server seat member 20, the compressible touch plate rod 116 of the foot touch plate assembly 110 is then detachably buckled to the first buckle ejection rod 92 of buckle ejection rod member 90 in order to restrain the movable rod 72 from being ejected upwardly prior to the actuation of the foot touch plate pedal 112 by the batter 12, as shown in FIG. 7. The compressible spring 118 of touch plate rod 116 serves to move the foot touch plate pedal 112 of the foot touch plate assembly 110 back to a start unbuckled position P after actuation of the baseball server apparatus 10 by the batter 12, as depicted in FIGS. 1, 3, 6 and 7 of the drawings.

Figure 4B:
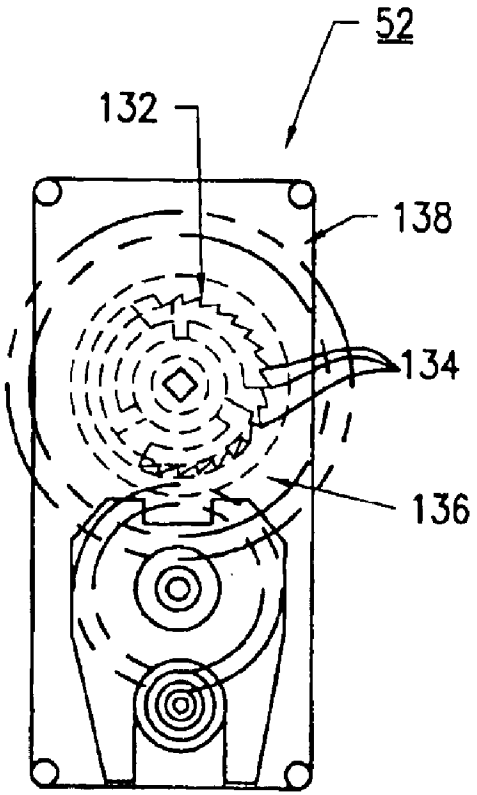
FIG. 4B is a front plan sectional view of the baseball server of the present invention taken along lines 4B—4B of FIG. 4A in the direction of the arrows showing the delay timer element and its component parts contained therein.
Figure 4A:
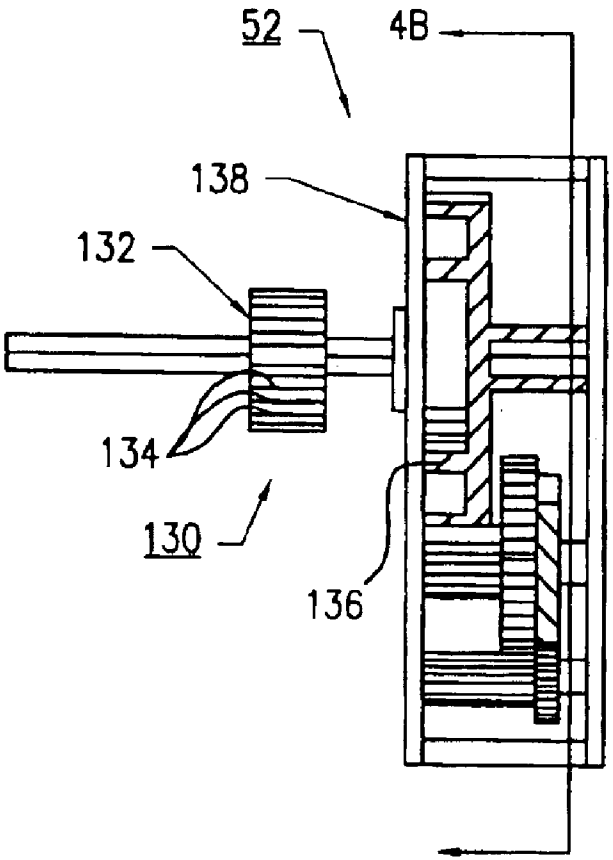
FIG. 4A is a side elevational view of the baseball server of the present invention showing a delay timer element and its component parts contained therein.

The delay timer element 52, as shown in FIGS. 1, 4A and 4B, includes a driver gear element 130 having a gear set 132 with a plurality of gear teeth 134 thereon and a delay unit 136 being housed within a case seat 138. The drive gear element 130 extends on the outside of the case seat 138. As previously indicated, the delay timer element 52 is installed and placed within the concave compartment 50 of the server seat member 20, wherein the driver gear element 130 cooperates with the driven rod section 94 of the first buckle ejection rod 92 of he buckle ejection rod member 90 such that the delay unit 136 of the delay timer element 52 can delay the operational movement of the driven rod section 92 of the buckle ejection rod member 90. The driven rod section 94 of buckle ejection rod member 90 is substantially in the form of a rod with a predetermined length and is engageable with the driver gear element 130 of delay timer element 52. The delay unit 136 of the delay timer element 52 has an effect of delaying the movement of the driven rod section 94 prior to the actuation of the movable rod 72 of the ejection assembly 70, as depicted in FIGS. 2, 4A, 4B and 6 of the patent drawings.

OPERATION OF THE PRESENT INVENTION

In operation, as depicted in FIGS. 1, 3, 5, 6 and 7 of the drawings, the baseball server apparatus 10 operates in the following manner. Referring to FIG. 3, when the server seat member 20 is in a standby ready position S in order to eject a ball 14 from the ball seat member 82, the movable rod 72 is pressed downwardly towards the server seat member 20 by the batter 12. In this initial step, the first buckle ejection rod 92 of the buckle ejection rod member 90 is detachably connected to the touch plate rod 116 of the foot touch plate assembly 110 so that the movable rod 72 is detachably connected to the foot touch plate assembly 110 and the driven rod section 94 of the buckle ejection rod member 90 is in contact with the driver gear element 130 of the delay timer element 52, as depicted in FIG. 3, allowing the baseball server apparatus 10 to be in a condition for actuation. Thus, the movable rod 72 is then activated with the delay timer element 52, as shown in FIGS. 1 and 3 of the drawings. In the next step, the batter 12 then places the ball 14 within the upper conical seat section 84 of the detachable ball seat member 82, such that the upper conical seat section 84 holds the lower portion 14*p* of the ball 14 therein, as shown in FIGS. 1 and 3, wherein the elastomeric ejection member 96 has the upward ejection force F in the standby mode S for ejecting the movable rod 72 by batter 12.

The baseball server apparatus 10 is actuated by the batter 12 by depressing the upper wall surface 124 of the foot touch plate pedal 112 of foot touch plate assembly 110 by the batters' foot 12*f*, as shown in FIG. 7, such that the movable rod 72 is ejected upwardly due to stored elastic force F of the elastomeric ejection member 96. Due to the action of the delay timer element 52, the movable rod 72 will rise up slowly. The movable rod 72 is then released from the action mode of the delay timer element 52, as shown in FIG. 6. The movable rod 72 can then rise up rapidly, after a predetermined time period, and the delay timer element 52 has been fully released. In this manner, the baseball 14 is propelled in an upwardly arched flight path B after the baseball ram member 80 of movable rod 72 hits the baseball 14, as shown in FIG. 7. After the movable rod 72 is actuated by the delay timer element 52 (a delay time period between 5 to 20 seconds), the batter 12 can then prepare for the next swinging movement SM, as depicted in FIG. 7 of the drawings.

The delay unit 134 of the delay timer element 52 effects the delaying action of the buckle ejection rod member 90 due to the plurality of gear teeth 134 of the gear set 132 and by the rotation of the gear set 132 during the ejection process of movable rod 72, as shown in FIGS. 3, 4A, 4B and 7 of the drawings. After the ejection of the baseball 14, the elastomeric ejection member 96 is reset by the compressible spring 98 of the ejection assembly 70, as shown in FIGS. 3 and 6 of the drawings, in preparation for the next swinging movement SM (see FIG. 7) of the bat 16 by batter 14.

ADVANTAGES OF THE PRESENT INVENTION

Accordingly, an advantage of the present invention is that it provides for a baseball server apparatus having a delay timer element for delaying a movable rod and the ejection of the ball so that a batter has a delayed time period for preparing his or her next swinging movement in order to hit the ejected baseball from the baseball server apparatus.

Another advantage of the present invention is that it provides for an ejection assembly for propelling the baseball in an upwardly direction such that the batter can adequately swing his or her bat in order to hit the baseball from the baseball server apparatus.

Another advantage of the present invention is that it provides for a foot touch plate assembly for actuating a movable rod within a server seat member in order to move the baseball in an upwardly arched flight path from a detachable baseball seat member.

Another advantage of the present invention is that it provides for a baseball server apparatus that is simple to use, uses only a limited space, is easy to maintain, and is capable of withstanding everyday wear and tear.

A still further advantage of the present invention is that it provides for a baseball server apparatus that can be mass produced in an automated and economical manner and is readily affordable by the consumer.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A ball server apparatus for conducting batting practice wherein the apparatus ejects a ball into the air and the user swings a bat in order to hit the ejected ball, comprising:

(a) a base member connected to a server seat member, said base member for stabilizing said server seat member on a playing surface;

(b) said server seat member including an interior section having a vertical channel extending therethrough;

c) a movable rod having a proximal end and a distal end; said proximal end of said movable rod being seated within the bottom of said server seat member; said proximal end of said movable rod having ejection means connected thereto; said distal end of said movable rod having a ball seat member connected thereto; said ball seat member for holding a portion of the ball therein;

(d) actuation means for actuating said ejection means in order to upwardly move said movable rod within said vertical channel for ejecting the ball from said ball seat member; wherein said activation means being a foot touch plate assembly actuated by the user's foot for actuating said ejection means; and (e) a delay timer element positioned within said interior section of said server seat member for delaying the ejection of the ball from said seat member in order to allow time for the user to prepare for a swinging movement prior to the ejection of the ball.

2. A ball server apparatus in accordance with claim 1, wherein said base member includes a mounting opening for receiving mounting means therethrough.

3. A ball server apparatus in accordance with claim 2, wherein said base member has the shape of a baseball home plate.

4. A ball server apparatus in accordance with claim 1, wherein said server seat member includes a first half shell casing and a second half shell casing connected together for forming said server seat member.

5. A ball server apparatus in accordance with claim 1, wherein said interior section includes an upper seat section, a middle seat section and a bottom seat section, and wherein said middle seat section includes a concave compartment for detachably receiving said delay timer element therein.

6. A ball server apparatus in accordance with claim 5, wherein said bottom seat section includes a holding seat member having a lower mounting opening and a centrally located mounting opening.

7. A ball server apparatus in accordance with claim 6, wherein said centrally located mounting opening (58) of said bottom seat section is aligned with and in contact with said centrally located mounting opening (62) of said base member for receiving mounting means therethrough in order to stabilize said ball server apparatus on the playing surface.

8. A ball server apparatus in accordance with claim 1, wherein said ball seat member includes an upper conical seat section being connected to a collar section having a through-hole opening for receiving said movable rod therethrough.

9. A ball server apparatus in accordance with claim 8, wherein said upper conical seat section of said ball seat member is configured to hold a part of the ball therein.

10. A ball server apparatus in accordance with claim 1, said distal end of said movable rod includes a ball ram member attached thereto; and said ball ram member is for striking and ejecting the ball from the ball seat member when said movable rod is actuated.

11. A ball server apparatus in accordance with claim 10, wherein said ball seat member is detachably mounted to said ball ram member.

12. A ball server apparatus in accordance with claim 1, wherein said ejection means on said proximal end of said movable rod includes an elastomeric ejection member, an ejection rod member having a first ejection rod and a driven rod section for forming an ejection assembly.

13. A ball server apparatus in accordance with claim 12, wherein said elastomeric ejection member includes a compressible spring and a piston rod in order to allow an upward elastic force F on said movable rod.

14. A ball server apparatus in accordance with claim 12, wherein said driven rod section interfits with said first ejection rod for forming said ejection rod member.

15. A ball server apparatus in accordance with claim 12, wherein said foot touch plate assembly is for actuating said elastomeric ejection member.

16. A ball server apparatus in accordance with claim 15, wherein said foot touch plate assembly includes a foot touch plate pedal having an upper and bottom surface a lever arm and a touch plate rod having a compressible spring thereon.

17. A ball server apparatus in accordance with claim 16, wherein said lever arm includes a proximal end and a distal end; said proximal end of said lever arm is attached to said bottom surface of said foot touch plate pedal and said distal end of said lever arm is connected to said touch plate rod and said compressible spring.

18. A ball server apparatus in accordance with claim 12, wherein said elastomeric ejection member is detachably received within the driven rod section of said first ejection rod of said ejection rod member.

19. A ball server apparatus in accordance with claim 18, wherein said touch plate rod of said foot touch plate assembly is detachably buckled to said first ejection rod of said ejection rod member in order to restrain said movable rod from being ejected upwardly prior to the actuation of said foot touch plate pedal by a batter during a standby mode.

20. A ball server apparatus in accordance with claim 1, wherein said delay timer element includes a driver gear element having a gear set with a plurality of gear teeth thereon and a delay unit.

21. A ball server apparatus in accordance with claim 20, wherein said driver gear element and said delay unit are housed within a case seat in said concave compartment for receiving said delay timer element therein.

22. A ball server apparatus in accordance with claim 20, wherein said driver gear element of said delay timer element cooperates with said driven rod section of said first ejection rod of said ejection rod member such that said delay unit of said delay timer element is allowed to delay the operational movement of said driven rod section of said ejection rod member.

23. A ball server apparatus in accordance with claim 20, wherein said delay unit is programmed for a delay time period in the range of 5 to 20 seconds prior to the actuation of said movable rod of said ejection assembly.

24. A ball server apparatus in accordance with claim 23, wherein said delay time period of said delay unit of said delay timer element is dependent upon said plurality of gear teeth on said gear set for providing said delay time period.

25. A ball server apparatus in accordance with claim 16, wherein said compressible spring of said touch plate rod is used for moving said foot touch plate pedal from a first position when in a standby mode to a second position when in an ejection mode.

26. A ball server apparatus in accordance with claim 15, wherein said foot touch plate assembly is detachably connected to said ejection assembly in order to restrain said movable rod from being ejected upwardly prior to the actuation of said foot touch plate assembly by a batter during a standby mode.

27. A ball server apparatus in accordance with claim 26, wherein said touch plate rod and said compressible spring of said foot touch plate assembly is detachably connected to said first ejection rod and said driven rod section of said ejection rod member of said ejection assembly in order to restrain said movable rod from being ejected upwardly prior to the actuation of said plurality of gear teeth of said gear set of said delay timer element and said delay unit for producing said delay time period on said first ejection rod in order to delay the operational movement of said driven rod section and said compressible spring of said foot touch plate assembly.

28. A method of employing a ball server apparatus for use by a single user to conduct batting practice wherein the ball server apparatus ejects a ball into the air and the user swings a bat in order to hit the ejected ball; the ball server apparatus includes a base member connected to a server member; a server seat member including an interior section having a vertical channel extending therethrough; said interior section of said server seat member including an upper seat section, a middle seat section and a bottom seat section; a movable rod having a proximal end and a distal end; said proximal end of said movable rod being seated within said bottom seat section of said server seat member; said proximal end of said movable rod having ejection means connected thereto; said distal end of said movable rod having a bail seat member connected thereto; actuation means for actuating said ejection means in order to upwardly move said movable rod within said vertical channel; and a delay timer element positioned within said interior section of said server seat member, comprising the steps of:

a) placing said base member on a playing surface for stabilizing said server seat member relative to the playing surface;

b) moving said movable rod in a downwardly direction such that said proximal end of said movable rod is detachably seated within said bottom seat section of said server seat member;

c) placing said movable rod in a standby mode in preparation for ejecting the ball from said ball seat member;

d) positioning a portion of the ball within said ball seat member;

e) actuating said ejection means by the user using said actuation means in order to upwardly move said movable rod within said vertical channel for ejecting the ball from said ball seat member;

f) delaying the ejection of the ball using said delay timer element in order to allow time for the user to prepare for a swinging movement prior to the ejection of the ball from said ball seat member; and g) swinging at the ejected ball while the ball is in the air in order to hit the ball by a bat of the user.

* * * * *